United States Patent [19]

Farrar et al.

[11] Patent Number: 4,516,346

[45] Date of Patent: May 14, 1985

[54] MAGAZINE FOR GUNS

[75] Inventors: Frank W. Farrar, Los Alamitos; Carl J. Cupp, Hawaiian Gardens, both of Calif.

[73] Assignee: Pachmayer Gun Works, Inc., Los Angeles, Calif.

[21] Appl. No.: 462,920

[22] Filed: Feb. 1, 1983

[51] Int. Cl.[3] ..... F41C 25/02

[52] U.S. Cl. ..... 42/50

[58] Field of Search ..... 42/50, 7

[56] References Cited

U.S. PATENT DOCUMENTS

| | | | |
|---|---|---|---|
| 1,299,303 | 4/1919 | Cowles | 42/50 |
| 2,620,582 | 12/1952 | Stokas | 42/50 |
| 2,885,811 | 5/1959 | Womble, Jr. | 42/50 |
| 3,143,819 | 8/1964 | Stevens, Jr. | 42/50 |
| 4,329,802 | 5/1982 | Coonan | 42/50 |

OTHER PUBLICATIONS

*American Rifleman;* Sep. 1956; p. 89, Feb. 1957; p. 56, Feb. 1960; p. 17.

*Primary Examiner*—Charles T. Jordan

*Attorney, Agent, or Firm*—William P. Green

[57] ABSTRACT

A magazine for holding a series of rounds of ammunition and including a spring pressed follower for yieldingly urging a series of rounds toward an upper end of a hollow magazine body, with a holding element connected to the follower for upward and downward movement therewith and for movement relative thereto between an active position for locking the follower in a lower setting to facilitate loading of rounds into the upper end of the magazine body and a released position permitting spring induced upward movement of the follower. The holding element may be actuable between its locking and released positions by rotary movement relative to the follower, and/or by generally horizontal sliding movement of the holding element relative to the follower. The holding element is preferably accessible through slots at two opposite sides of the magazine body in a relation enabling the actuating element to be gripped very effectively between the thumb and forefinger of a user's hand for positive controlled actuation between holding and released positions.

16 Claims, 11 Drawing Figures

MAGAZINE FOR GUNS

BACKGROUND OF THE INVENTION

This invention relates to improved magazines for holding a series of rounds of ammunition in a gun.

A known type of magazine for holding a series of rounds to be fed to and fired successively by an automatic pistol or the like includes a hollow magazine body containing a follower urged upwardly by a spring to progressively advance the rounds toward a firing location. The magazine is reloaded by removing it downwardly from the gun and then filling additional rounds into the magazine body through its upper end. As these rounds are inserted into the magazine body, the follower must move downwardly against the tendency of its actuating spring, with this spring thus acting to resist the loading operation. In a conventional magazine, the user may pull the follower downwardly to a lower position in order to allow the rounds to be fed into the magazine, and may hold the follower manually in that lower position until all of the rounds have been loaded. However, it is extremely inconvenient to exert such downward force on the follower relative to the magazine body during all of the time that the magazine is being filled.

SUMMARY OF THE INVENTION

An object of the present invention is to provide a novel arrangement for very effectively and positively holding the follower in a magazine of the above discussed type in a lower position without the necessity for continuously applying downward manual force to the follower while rounds are fed into the upper portion of the magazine. This purpose is achieved by provision of a holding structure which is mounted to the follower for upward and downward movement therewith in the magazine body, and which is also actuable relative to the follower between a holding position for locking the follower in its lowermost setting and a released position permitting upward spring induced movement of the follower against the inserted rounds. The holding structure may be actuable between active and released positions by manual rotary movement of the holding structure about a predetermined axis, or by generally horizontal sliding movement, or by both of these types of movement. To facilitate such actuation and control of the holding structure, it is preferably designed to be manually accessible from two opposite sides of the magazine body, through slots formed in opposite side walls of the body, in a relation enabling the holding structure to be contacted by and gripped between the thumb and forefinger of a user's hand and thereby afford a very effective control on upward and downward movement of the holding structure. In a lower position of the follower, the holding structure can be moved relative to the follower to a condition in which the holding structure engages enlarged lower portions of the slots in the magazine body and in that way blocks upward movement of the holding structure and follower.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENT

Figure 1:
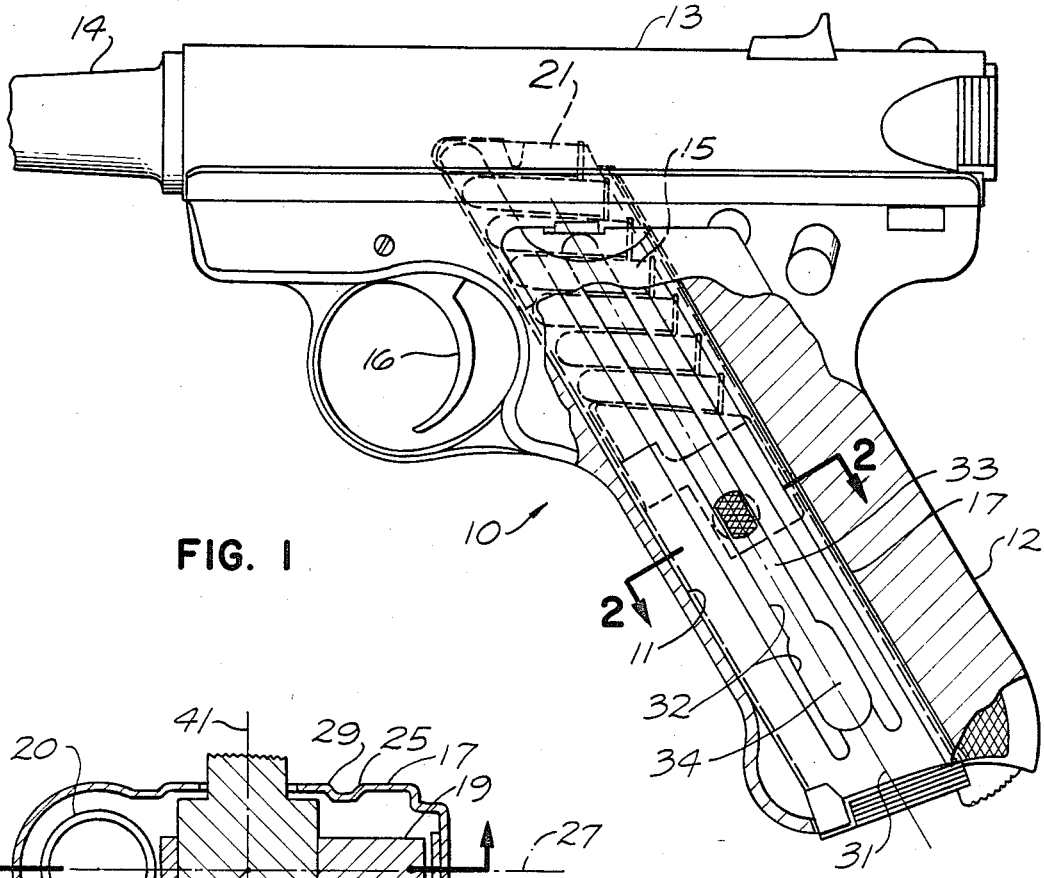
FIG. 1 is a side view representation of a magazine constructed in accordance with the invention and shown positioned within a fragmentarily illustrated gun.

The magazine 10 of FIGS. 1-7 is illustrated in FIG. 1 as inserted upwardly into a recess or guideway 11 formed in the handle 12 of a conventional automatic pistol 13 having a barrel 14 through which a series of rounds of ammunition 15 are fired under the control of the usual trigger 16. The rounds are contained within magazine 10 and are fed successively from the upper end of the magazine to the action of the gun.

The magazine includes a hollow generally vertically elongated generally tubular body 17 defining a vertically extending chamber or guideway 18 within which the rounds 15 are stacked in horizontally extending condition above a follower 19 which is yieldingly urged upwardly by a spring 20 to always urge the upper one of the remaining rounds in the magazine to an upper feeding position 21 from which that round is delivered into the firing chamber at the rear of barrel 14. The top end of magazine body 17 has inwardly turned flanges 56 which are engageable with the upper round, or with follower 19 when no rounds are present, to limit upward movement of the round or follower. The front wall 22 of the magazine body has a notch or recess 23 at its upper end dimensioned to pass the uppermost round forwardly to the firing chamber.

The lower end of magazine body 17 is closed by a bottom plate 24, against which the lower end of spring 20 bears downwardly. Plate 24 may be detachable from body 17 in any conventional or other desired manner, as by provision of a sliding connection between the magazine and plate 24 permitting the latter to be slidably withdrawn from the full line position of FIG. 3 to the broken line position of that figure.

Figure 2:
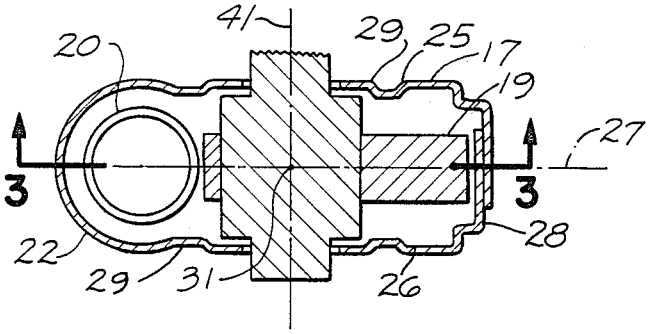
FIG. 2 is an enlarged transverse section through the magazine taken on line 2—2 of FIG. 1.

The magazine body may have the transverse crossectional configuration illustrated in FIG. 2, being defined by two opposite side walls 25 and 26 disposed essentially parallel to one another and to the central vertical front to rear plane 27 of the magazine and gun, with front and rear walls 22 and 28 joining the side walls at their front and rear edges. These various walls 22, 25, 26 and 28 may be contoured as illustrated in FIG. 2, and with the side walls typically being strengthened by provision of vertically extending recessed areas 29.

In the FIG. 1 position of use, the magazine and its body 17 are inclined to extend upwardly and forwardly along an inclined axis 31 in essential correspondence with the similar inclination of handle 12 of the gun. Side walls 25 and 26 of the magazine body contain vertically elongated slots 32 which extend parallel to axis 31 of the magazine and which have upper elongated narrow portions 33 of a width w and lower wider portions 34 of a width t, with downwardly facing shoulders 35 defined by the edges of these slots at the juncture of their upper and lower portions 33 and 34. The two slots 33 of walls 25 and 26 are identical to one another, with their shoulders 35 disposed at the same level near the bottom of the magazine.

Figure 3:
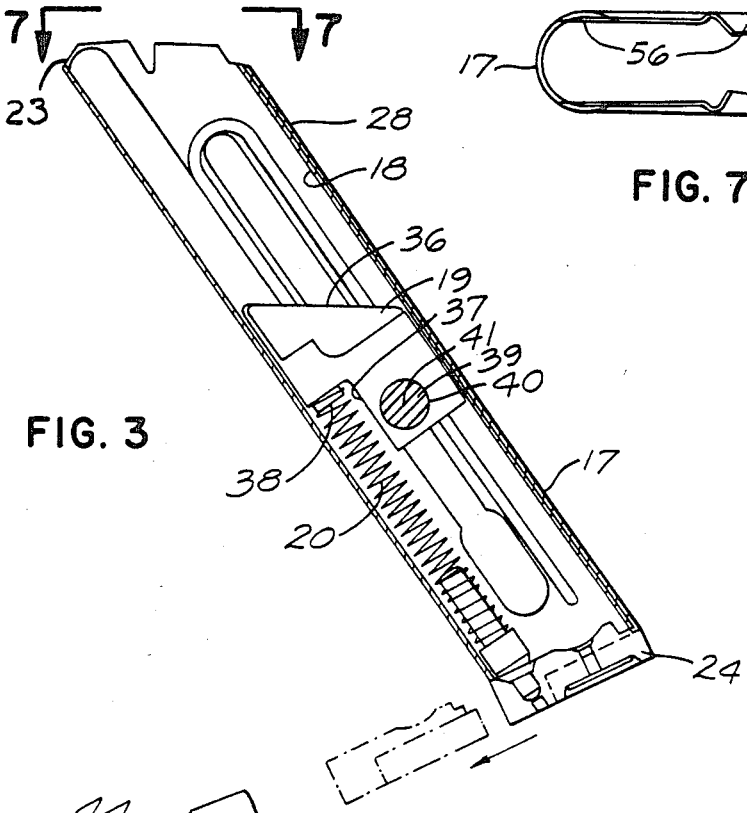
FIG. 3 is a vertical section through the magazine taken on line 3—3 of FIG. 2 in the main front to rear central plane of the gun.
Figure 7:
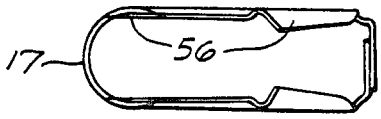
FIG. 7 is a view on line 7—7 of FIG. 3.

Follower 19 may be of essentially conventional construction, having the vertical outline configuration illustrated in FIG. 3, with a top surface 36 of the follower being disposed essentially horizontally, in correspondence with the essentially horizontally extending top flanges 56 of the magazine body, to hold the rounds 21 in a proper horizontal condition for delivery to the firing chamber. Spring 20 may extend upwardly into a recess 37 formed in the follower, and have its upper end disposed about and located by a short cylindrical boss portion 38 of the follower to retain the spring in proper orientation with respect to the follower.

Figure 4:
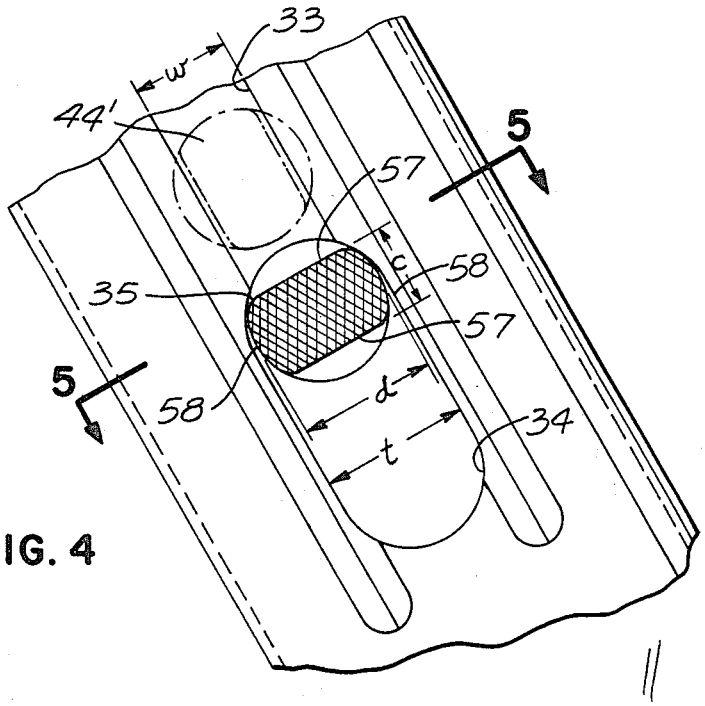
FIG. 4 is an enlarged fragmentary side view corresponding to a portion of FIG. 1 but showing the follower locked in a lower position.

The follower is adapted to be latched in the lower position of FIG. 4 by a locking element 39, which extends through and is movable within a cylindrical bore or passage 40 formed in the follower and extending along and centered about a horizontal axis 41 disposed perpendicular to vertical central front to rear axis 27 of the magazine. Element 39 has a main portion 42 having an outer cylindrical surface 43 which is a close fit within bore 40 but sufficiently loose to permit element 39 to be shifted axially relative to follower 19 (along axis 41) and to be turned rotatively about that axis 41 relative to the follower. At the opposite ends of its main central portion 42, locking element 39 has two opposite end portions 44 and 45, which project through the two slots 32 respectively at opposite sides of the magazine body, and which terminate in outer end faces 46 disposed transversely of axis 41 and parallel to vertical plane 27. In the FIGS. 2 and 5 positions of the locking element, end portions 44 and 45 of that element project laterally outwardly beyond the planes of side walls 25 and 26 at the locations of slots 33, so that the two surfaces 46 can be simultaneously engaged by the thumb 47 and forefinger 48 of a user to grip element 39 tightly therebetween in a manner facilitating controlled manual movement of locking element 39 by the user's hand. To enhance this control, surfaces 46 may be knurled, checkered, or otherwise irregularized, as shown.

Figure 5:
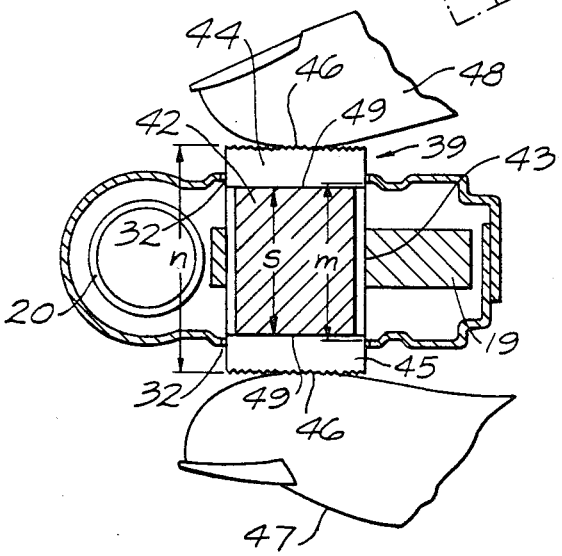
FIG. 5 is a transverse generally horizontal section taken on line 5—5 of FIG. 4.

The juncture between the main cylindrical portion 42 of locking element 39 and each of its opposite end portions 44 and 45 is defined by shoulders 49 disposed transversely of axis 41 and parallel to plane 27. As seen in FIG. 5, the axial spacing s between shoulders 49, and thus the axial length of cylindrical portion 42 of element 39, is less than the spacing m between side walls 25 and 26 of the magazine body at the locations of slots 33, while the axial spacing n between the finger engageable opposite end surfaces 46 of element 39 is greater than the spacing m to allow the desired projection of surfaces 46 beyond the slots as discussed. Portions 44 and 45, as viewed in transverse section perpendicular to axis 41 of the locking element 39, have the non-circular generally rectangular vertical sectional configuration illustrated in FIG. 4, with a narrow width dimension c in one direction between two parallel planar surfaces 57 and a greater dimension d in a direction perpendicular to that of the width c and defined by cylindrical surfaces 58 aligned with and forming in effect continuations of surface 43 of portion 42. The width c is narrow enough to permit reception of portions 44 and 45 within the upper elongated portions 33 of slots 32 in the condition illustrated in FIGS. 1 and 2, and in broken lines at 44' in FIG. 4. When the locking element 39 is turned through ninety degrees (90°) from the FIG. 1 position to the full line condition of FIG. 4, however, portions 44 and 45 of element 39 can not be received within narrow portions 33 of slots 32, but can be received within the lower larger width portions 34 of the slots. It is also noted in the FIGS. 1 and 2 condition of the locking element and follower, the cylindrical portion 42 of locking element 39 is received entirely between the two slots 33, with its end shoulders 49 being engageable with the inner sides of walls 25 and 26 in a relation preventing axial movement of enlarged portion 42 through either of the slots. When the locking element is in its lower FIG. 4 position, however, cylindrical portion 42 of the locking element can be shifted axially in either direction along axis 41 and into the lower enlarged width portion 34 of one of the slots 33, and in that condition is engageable upwardly against shoulders 35, which curve arcuately in correspondence with the outer cylindrical surface of portion 42, to lock element 39 and the follower in that lower setting.

To now describe the manner of use of the magazine, assume that the magazine is partially loaded and within a gun as illustrated in FIG. 1. As the top round 15 in the magazine is fed forwardly from the magazine to the barrel, spring 20 advances the follower 19 and the remaining rounds upwardly to bring the next successive upper round into position for delivery to the chamber. After all of the rounds have been fed from the magazine in this manner, follower 19 will be in its uppermost position within the magazine body, in engagement with shoulders 56. The magazine is then withdrawn downwardly from the gun and reloaded. To facilitate reloading, the user pulls the follower downwardly to the bottom of the magazine body and locks it in a lower position as represented in FIG. 4 to enable a series of rounds to be easily inserted into the upper end without the necessity for overcoming the spring force and pushing the follower farther downwardly as each round is inserted. More specifically, a user may grasp locking element 39 between his thumb and forefinger as represented in FIG. 5, and while gripping the locking element in this manner may pull it and the connected follower 19 downwardly slightly beyond the position illustrated in full lines in FIG. 4, at which point he may turn the locking element about its axis 41 by corresponding movement of the thumb and forefinger while still gripping the locking element, with the latter being turned through ninety degrees (90°) to the full line position of FIG. 4 or at least partially to that condition so that the then transversely extending end portions 44 and 45 of element 39 are in positions in which they can no longer move upwardly into the reduced width portions 33 of slots 32. The cylindrically curving surfaces 58 of end portions 44 and 45 engage upwardly against the correspondingly curving shoulders 35 and thus positively hold the follower in its lower position. After a desired number of rounds have been fed into the magazine, the user again grasps element 39 between his thumb and forefinger, pulls the locking element slightly downwardly and then turns the locking element through ninety degrees (90°) or enough of an angle to again return it to a position of alignment with the narrow portions 33 of slots 32, so that the non circular portions 44 and 45 can move upwardly into those narrow portions of the slots as represented in broken lines at 44' in FIG. 4. The spring is then able to advance the follower upwardly a short distance and just far enough to hold the stack of inserted rounds 15 against the upper shoulders 21 at the top of the magazine for automatic delivery to the gun.

Figure 6:
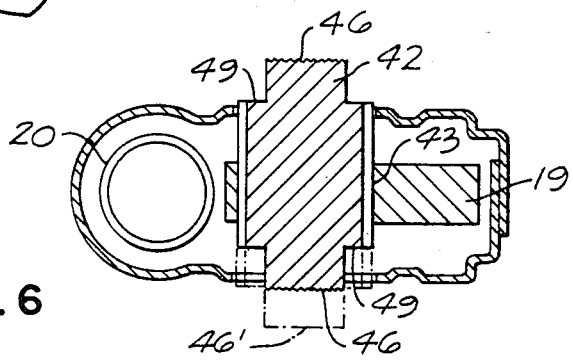
FIG. 6 is a view similar to FIG. 5, but showing the locking element shifted axially to a second locking condition.

An alternative way of locking the follower in its lower position of FIG. 4 is illustrated in FIG. 6, and involves grasping element 39 between the thumb and forefinger as discussed and then shifting element 39 along axis 41 from its central FIG. 5 position, in either direction, to the full line position of FIG. 6 or the broken line position of that figure. In either of those conditions, the cylindrical portion 42 of the locking element 39 is received within the lower wider portion 34 of one of the slots 32, and is engageable upwardly against shoulders 35 at the juncture of the narrow and wide portions of that slot, to block upward movement of the locking element and the connected follower. This locked condition is released by again grasping element 39 between the thumb and forefinger and pressing it inwardly to the FIG. 5 centered condition in which the locking element can move upwardly into portions 33 of the slots, assuming that the non-circular portions 44 and 45 of element 39 are turned so that their narrow dimensions are in proper alignment with the slots.

FIGS. 8 through 11 show a variational type of magazine 10*a* which may be the same as magazine 10 of FIGS. 1 through 7 except as to the construction of locking element 39*a*. The magazine body 17*a*, follower 19*a* and bottom plate 24*a* of FIGS. 8 through 11 may all be identical with parts 17, 19 and 24 of the first form of the invention, and the follower may be urged upwardly against rounds 15*a* by a spring such as that shown at 20 in FIG. 3.

Locking element 39*a* has a main portion 42*a* with an outer cylindrical surface 43*a* which is a close fit within bore 40*a* formed in follower 19*a* and centered about a horizontal axis 41*a* corresponding to axis 41 of the first form of the invention. The follower is thus mounted for rotary and axial movement about axis 41*a* relative to the follower and the magazine body. At opposite ends of its cylindrical portion 42*a*, the locking element 39*a* has two opposite end portions 44*a* and 45*a* which are of the same non-circular cross-sectional configuration about axis 41*a* as are the portions 44 and 45 of FIGS. 1 to 7, with this cross-sectional configuration being defined by parallel surfaces 57*a* and curved surfaces 58*a* corresponding to surfaces 57 and 58 of FIG. 4.

Figure 8:
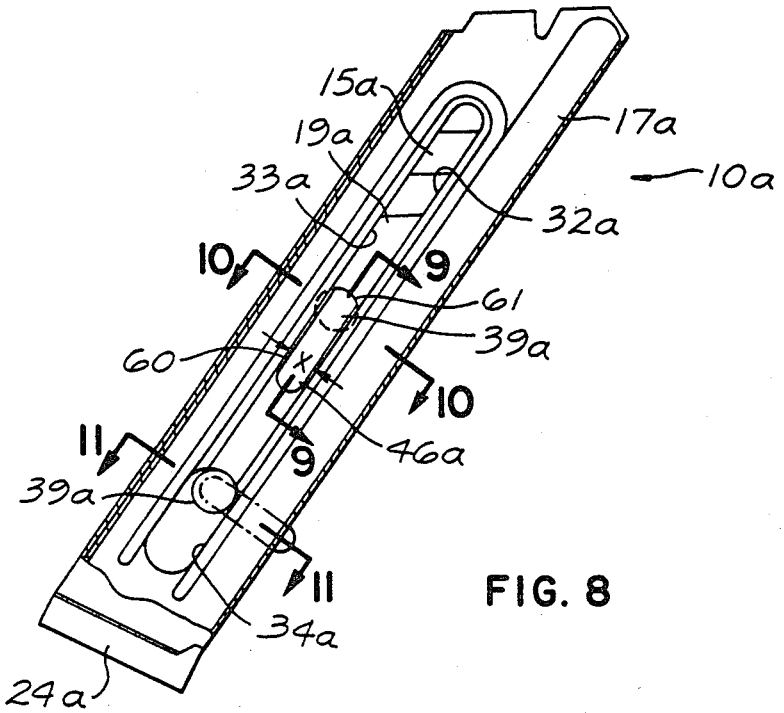
FIG. 8 is a side view of another form of magazine embodying the invention.
Figure 9:
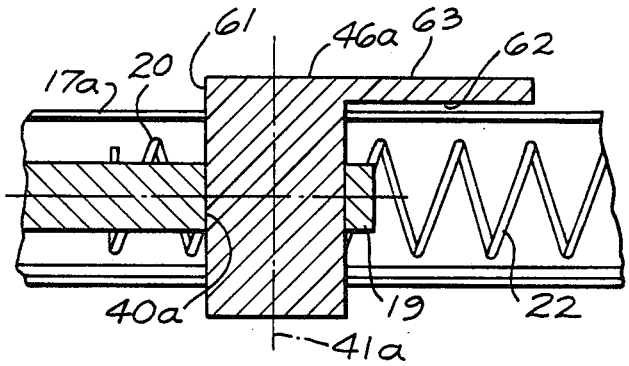
FIGS. 9 and 10 are sections taken on lines 9—9 and 10—10 of FIG. 8.
Figure 10:
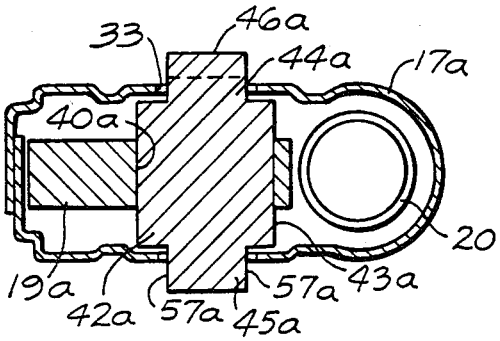
Figure 11:
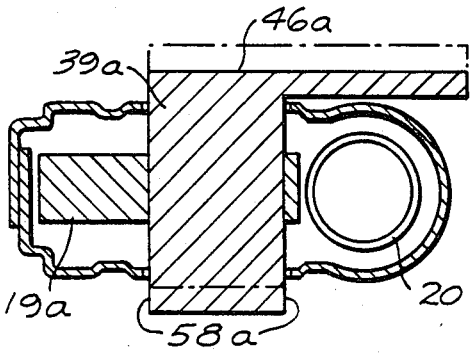
FIG. 11 is a section on line 11—11 of FIG. 8, showing the locking element in its active latching condition.

For manually rotating locking element 39*a* between its holding and released positions, the portion 44*a* carries at the outside of magazine body 17*a* and beyond one of the slots 32*a* in that body an arm or handle portion 46*a* of locking element 39*a* which projects transversely of the rotary axis 41 of the locking element and in the released position of the locking element may extend essentially longitudinally of slots 32*a* as represented in full lines in FIG. 8. The arm may have a width x slightly less than the width of the upper narrow portions 33*a* of slots 32*a*, and corresponding to the narrow dimension of non-circular portions 44*a* and 45*a* of the locking element, with the opposite side surfaces 60 of arm 46*a* typically lying in the same planes as opposite side surfaces 57*a* of portions 44*a* and 45*a* of the locking element. An end surface 61 of arm 46*a* may be curved in correspondence with and be a continuation of one of the curved surfaces 58*a* of portion 45*a* of the locking element, while the arm 46*a* projects beyond the other curved surface as viewed in FIG. 8. The inner surface 62 of arm 46*a* may be planar and disposed transversely of axis 41*a* and be received closely adjacent one of the side walls of magazine housing 17*a*, to enable the arm to be swung about axis 41*a* between positions such as those shown in full lines and broken lines in FIG. 8. The outer surface 63 of arm 46*a* may be disposed parallel to inner surface 62. The second non-circular portion 45*a* of locking element 39*a* may be the same as portion 45 of the first form of the invention.

When the magazine 10*a* of FIGS. 8 through 11 is in use within a gun, arm 46*a* is swung to a position such as that represented in full lines in FIG. 8, in which the non-circular portions 44*a* and 45*a* of locking element 39*a* have their side surfaces 57*a* disposed parallel to the length of magazine body 17*a* and its slots 32*a*, giving the non-circular portions a minimum effective width less than that of the slots enabling those portions to move longitudinally within the slots as the rounds 15*a* are successively fired. After the last round has been fired, the magazine is withdrawn from the gun for reloading. The locking element 39*a* is pressed downwardly relative to magazine body 17*a* by engaging element 39*a* manually at opposite sides of the housing and pushing it to a position in which non-circular portions 44*a* and 45*a* of element 39*a* are received within the lower enlarged diameter portions 34*a* of slots 32*a*, enabling element 39*a* to be turned through 90° (ninety degrees) by swinging movement of arm 46*a* to the broken line position of FIG. 8. This gives the non-circular portions 44*a* and 45*a* an increased effective width as represented in FIG. 4 in connection with the first form of the invention, locking element 39*a* against upward movement so that a series of rounds 15*a* can be inserted into the magazine above the follower without manually holding the follower downwardly against the force of its actuating spring. It is also contemplated that locking element 39*a* may be actuated to locking condition by axial movement, in a manner similar to that represented in FIG. 6 in connection with the first form of the invention, and by pressing inwardly on portion 44*a* in FIG. 11 to shift element 39*a* axially to the broken line position of that figure. Such axial movement will lock element 39*a* and the follower in its lower position without swinging movement of arm 46*a* between the full line and broken line positions of FIG. 8.

While certain specific embodiments of the present invention have been disclosed as typical, the invention is of course not limited to these particular forms, but rather is applicable broadly to all such variations as fall within the scope of the appended claims.

We claim:

1. A magazine comprising:

a magazine body to be inserted into a gun and adapted to contain a series of rounds of ammunition;

a follower movable upwardly and downwardly within said magazine body beneath said rounds to urge them upwardly;

a spring yieldingly urging said follower upwardly; and a holding structure mounted to said follower for movement upwardly and downwardly therewith and for rotary movement relative to the follower about an axis between an active position in which said structure retains the follower against movement upwardly from a lower setting thereof and a released position permitting such upward movement;

said holding structure being also mounted for movement axially along said axis relative to said follower and operable by said axial movement to releasably latch the follower against upward movement.

2. A magazine as recited in claim 1, in which said magazine body has an elongated slot in a side wall thereof with an upper narrow portion and a lower increased width portion, said holding structure having a non-circular portion receivable within said slot and which in said active rotary position of the holding structure has an effective width which is greater than said upper narrow portion of the slot but is receivable within said lower increased width portion to block upward movement of the holding structure, said non-circular portion in said released position having a reduced effective width narrow enough for movement upwardly into said upper narrow portion of the slot.

3. A magazine as recited in claim 1, in which said magazine body has a slot with an upper narrow portion and a lower increased width portion, said holding structure having a locking portion which is wider than said upper narrow portion of the slot and is movable into and out of said lower increased width portion of the slot by axial movement of the holding structure in a relation releasably locking the follower in a lower setting.

4. A magazine comprising:

a magazine body to be inserted into a gun and adapted to contain a series of rounds of ammunition;

a follower movable upwardly and downwardly within said magazine body beneath said rounds to urge them upwardly;

a spring yieldingly urging said follower upwardly; and a holding structure mounted to said follower for movement upwardly and downwardly therewith and for rotary movement relative to the follower about an axis between an active position in which said structure retains the follower against movement upwardly from a lower setting thereof and a released position permitting such upward movement;

said magazine body having opposite side walls containing two elongated slots with upper narrow portions and lower increased width portions;

said holding structure having portions projecting laterally in opposite directions into said slots and which are non-circular to have an effective width in said active position greater than said upper narrow portions of the slots but adapted to be received within said lower increased width portions in a relation blocking upward movement of the holding structure;

said holding structure having a reduced effective width in said released position narrow enough for movement upwardly into said upper narrow portions of the slot.

5. A magazine as recited in claim 4, in which said projecting portions of the holding structure extend laterally beyond opposite sides of said magazine body for engagement by the thumb and forefinger of a user in turning the holding structure about said axis between said positions thereof.

6. A magazine as recited in claim 4, in which one of said projecting portions of the holding structure has an arm at the outside of said magazine body extending generally transversely of said axis and adapted to be manually swung about said axis to turn said holding structure between said positions thereof.

7. A magazine as recited in claim 4, in which said holding structure has a locking portion receivable between said opposite side walls of the body and movable into said lower increased width portion of at least one of said slots by axial movement of the holding structure along said axis, and which is of a width greater than said upper narrow portion of the slot to lock the follower in a lower setting.

8. A magazine as recited in claim 4, in which said axis extends transversely of the direction of the movement of said holding structure, said non-circular portions of the holding structure having irregularized outer end surfaces engageable by the thumb and forefinger of a user, said holding structure having a cylindrical portion between said non-circular portions and receivable between said side walls and which is wider than said upper narrow portions of the slots and movable into said lower increased width portions thereof by axial movement of the holding structure in a relation locking the follower in a lower setting.

9. A magazine comprising:

a magazine body to be inserted into a gun and adapted to contain a series of rounds of ammunition;

a follower movable upwardly and downwardly within said magazine body beneath said rounds;

a spring yieldingly urging said follower upwardly; and a holding structure mounted to said follower for movement upwardly and downwardly therewith and for movement relative to the follower between an active position retaining the follower against movement upwardly from a lower setting thereof and a released positions permitting upward movement of the follower;

said holding structure having actuating portions accessible from opposite sides of said magazine body for engagement by the thumb and forefinger of a user's hand in a relation gripping the holding structure therebetween for positive manual movement of the holding structure between said active and released positions relative to the follower;

said holding structure being mounted for rotary movement relative to said follower between said active and released positions of the holding structure.

10. A magazine as recited in claim 9, in which said magazine body has slots extending generally vertically along said opposite sides thereof and through which said actuating portions are accessible to the thumb and finger of a user.

11. A magazine as recited in claim 9, in which said magazine body has an elongated slot extending generally vertically along a side thereof and having a lower enlarged width portion within which said holding structure is receivable in a position retaining the follower against upward movement relative to the magazine body.

12. A magazine comprising:

a magazine body to be inserted into a gun and adapted to contain a series of rounds of ammunition;

a follower movable upwardly and downwardly within said magazine body beneath said rounds;

a spring yieldingly urging said follower upwardly; and a holding structure mounted to said follower for movement upwardly and downwardly therewith and for movement relative to the follower between an active position retaining the follower against movement upwardly from a lower setting thereof and a released position permitting upward movement of the follower;

said holding structure having actuating portions accessible from opposite sides of said magazine body for engagement by the thumb and forefinger of a user's hand in a relation gripping the holding structure therebetween for positive manual movement of the holding structure between said active and released positions relative to the follower;

said holding structure being mounted for sliding movement relative to said follower generally horizontally and essentially transversely of the magazine body between said active and released positions of the holding structure;

said holding structure being mounted also for rotary movement relative to the follower about an axis disposed generally horizontally and being operable by such rotary movement to releasably lock the follower against upward movement from a lower position thereof.

13. A magazine comprising:

a magazine body to be inserted into a gun and adapted to contain a series of rounds of ammunition and containing an elongated slot;

a follower movable upwardly and downwardly within said magazine body beneath said rounds to urge them upwardly;

a spring yieldingly urging said follower upwardly; and a holding structure mounted to said follower for movement upwardly and downwardly therewith and along said slot and for rotary movement relative to the follower about an axis between an active position in which said structure retains the follower against movement upwardly from a lower setting thereof and a released position permitting such upward movement;

said axis of rotary movement of said holding structure extending through said slot between the interior and exterior of said magazine body.

14. A magazine as recited in claim 13, in which said holding structure has an actuating arm at the outside of said magazine body adapted to be manually swung about said axis to turn the holding structure between said active and released positions.

15. The method of preparing a magazine for loading, with the magazine including a hollow body having a slot, a follower, a spring urging said follower in a predetermined direction, and a latching element which moves along said slot, said method comprising:

depressing said follower and said latching element together relative to said magazine body against the tendency of said spring to a loading position; and then turning said latching element relative to said follower, about an axis extending through said slot between the interior and exterior of said body, to a latching position of said element in which it releasably holds the follower against returning movement by the spring.

16. A magazine comprising:

a magazine body to be inserted into a gun and which is adapted to contain a series of rounds of ammunition and has a side wall containing an elongated slot having an upper narrow portion and a lower increased width portion;

a follower movable upwardly and downwardly within said magazine body beneath said rounds to urge them upwardly;

a spring yieldingly urging said follower upwardly; and a holding structure mounted to said follower for movement upwardly and downwardly therewith and for rotary movement relative to the follower about an axis extending through said slot between the interior and exterior of the magazine;

said holding structure having a non-circular portion received within said slot and adapted to turn about said axis between an active locking position in which said non-circular portion has an effective width greater than said upper narrow portion of the slot but receivable within said lower increased width portion to block upward movement of the holding structure and follower, and a released position having a reduced effective width narrow enough for movement upwardly into said upper narrow portion of the slot.

* * * * *